United States Patent [19]

Takeuchi

[11] 4,038,067

[45] July 26, 1977

[54] CARBON-FREE CASTING POWDER FOR INGOT CASTING AND CONTINUOUS CASTING

[75] Inventor: Hidemaro Takeuchi, Hikari, Japan

[73] Assignee: Nippon Steel Corporation, Tokyo, Japan

[21] Appl. No.: 693,901

[22] Filed: June 8, 1976

[30] Foreign Application Priority Data

June 13, 1975 Japan ..... 50-71694

[51] Int. Cl.[2] ..... C21C 7/00; C22B 9/10

[52] U.S. Cl. ..... 75/257; 75/53

[58] Field of Search ..... 75/94, 93, 53, 130 R; 423/409; 148/26

[56] References Cited

U.S. PATENT DOCUMENTS

| | | | |
|---|---|---|---|
| 2,467,647 | 4/1949 | Alexander | 423/409 |
| 3,429,661 | 2/1969 | Neuenschwander | 423/409 |
| 3,450,499 | 6/1969 | Yates | 423/409 |

*Primary Examiner*—Peter D. Rosenberg

*Attorney, Agent, or Firm*—Watson, Leavenworth, Kelton & Taggart

[57] ABSTRACT

A casting powder to be used for ingot casting and continuous casting of steel which contains substantially no carbon particles.

It contains, instead of carbon particles, BN or other nitrides as an agent for adjusting fusion rate of the casting powder so as to fully prevent carburization and carbon pick-up caused by the carbon particles which has heretofore been added to the powder for control of the fusion rate. This new casting powder may contain a reducing agent in addition to the nitride.

9 Claims, 11 Drawing Figures

| KIND | PRIOR ART | THIS INVENTION |
|---|---|---|
| STAINLESS STEEL (BLOOM) | ○ | ● |
| Si-STEEL (SLAB) | △ | ▲ |
| LOW CARBON STEEL (SLAB) | □ | ■ |

CARBON-FREE CASTING POWDER FOR INGOT CASTING AND CONTINUOUS CASTING

DETAILED DESCRIPTION OF THE INVENTION.

This invention relates to a carbon-free casting powder to be used for ingot casting and continuous casting, and more particularly to such casting powder capable of preventing carburization and carbon pick-up of a product steel which would otherwise be caused by carbon particles mixed in said powder.

The casting powder which has generally been used for the normal ingot casting or the continuous casting of steel contains carbon particles in an amount of several % to 10 and several % by weight of the powder. This carbon contained in the powder will give rise to the curburization or carbon pick-up on the surface or inside of the ingot or the slab or bloom at the time of ingot casting or of continuous casting of steel. The surface layer of carburization or carbon pick-up thus obtained remains in the product steel, particularly in the steel of low carbon steel grade such as stainless steel, low carbon steel for cold sheet, silicon steel, etc., which results in a remarkable degradation of the product with respect to its quality and yield.

This invention has now developed a novel casting powder which obviates the degradation of the quality of the product which results from the carburization and carbon pick-up caused by the conventional carbon-containing casting powder. According to the general findings which have heretofore been prevailing, the behavior of the carbon particles contained in the casting powder is as follows:

When a casting powder containing $SiO_2$, CaO, $Al_2O_3$, FeO, MnO and MgO as the main component and $Na_2O$, $K_2O$, $Li_2O$, NaF, KF and $AlF_3$ as the flux is added to the surface of a metal bath in the mould, referred to as the basic particles, all the powder is melted rapidly on the surface of the metal bath and some sintered particles floats on the molten slag layer according to the radiant cooling from the surface of the slag, which will give rise to a defect of the surface of ingot, slab or bloom such as the entrapped slag or the rough cast surface, etc. Accordingly, the casting powder used for ingot casting or continuous casting should contain such carbonaceous particles as powdered coke or carbon black as the skeleton particles, so as to prevent the contact and the fusion-accumulation of the slag particles and control the fusion rate. In this case, a two layer, i.e. molten slag and powder may be formed whereby the slag layer is completely covered by the adiabatic casting powder layer. In this sense, the mixing of the carbon particles has heretofore been considered to be essential in view of the above effect.

This invention is based on the finding that, when some other particles than the carbon particles having the same effect as the latter is added instead of the carbon particles, the casting powder will remain unfused and keep its advantage and yet prevent the carburization or carbon pick-up which would otherwise be encountered in a process of this kind. After various studies, it has now been found that such nitrides as BN, $Si_3N_4$, MnN, $Cr_2N$, $Fe_4N$, AlN, TiN and ZrN have the same property as the carbon particles, and that if they are mixed into the basic particles in a proper size and a proper amount, they can adjust the fusion rate of the casting powder as the carbon particles can do, whereby the carburization and carbon pick-up may be fully prevented.

It is therefore an object of this invention to provide a casting powder used for ingot casting or continuous casting capable of obviating the carburization and carbon pick-up of the steel ingot, slab or bloom caused by the carbon particles conventionally incorporated therein.

According to this invention, there is provided a carbon-free casting powder consisting chiefly of basic powders which comprises a nitride as skeleton particles in said basic powders, said nitride being in particle size of 50 mesh or finer, said basic powders containing substantially no carbon particles.

The invention is further described with respect to the drawings.

Figure 1:
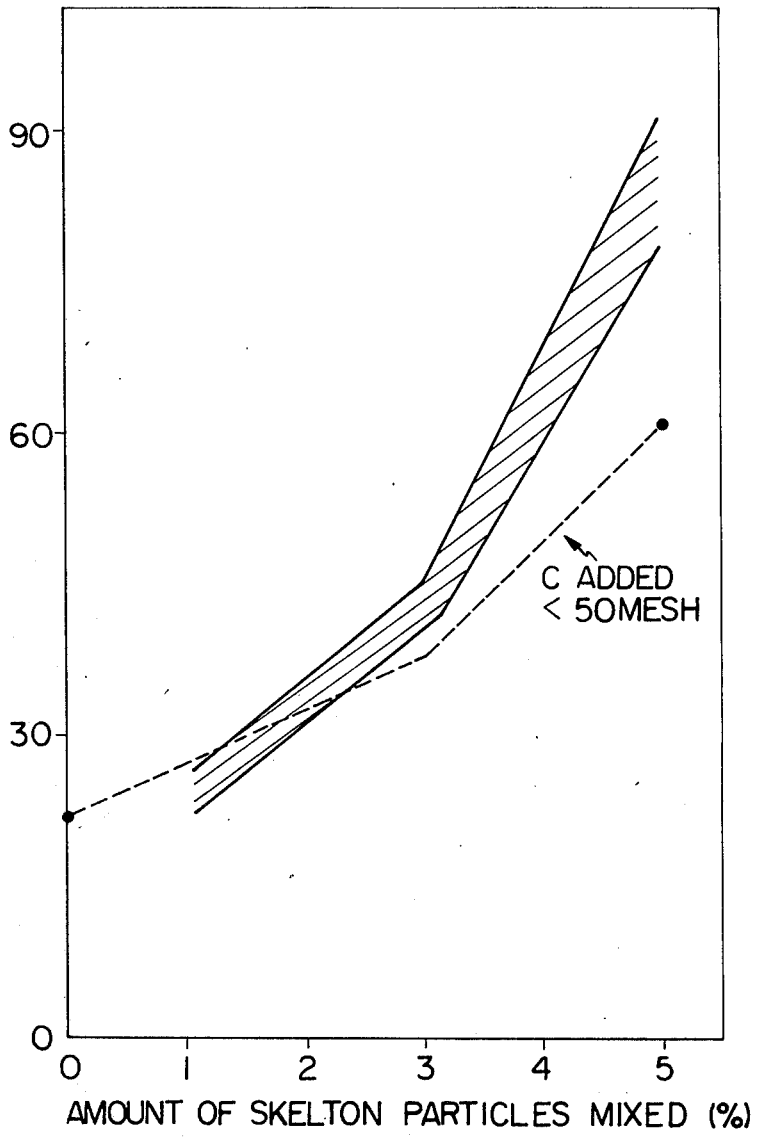
FIG. 1 is a graph showing the effect of the nitride particles in comparison with that of the carbon particles upon the fusion rate of the casting powder.

In FIG. 1 and in Table 1, the effects of the nitrides and the carbon as the skeleton particles upon the fusion rate control of the casting powder are shown. In this case, the casting powder contains the nitride or the carbon and it is charged into a 20 Kg molten bath of AISI 304 steel which is kept at 1500° C and the fusion rate of various powders is measured.

The purity and the particle size of the nitride and the carbon used in the tests are shown in Table 2 and the composition of the basic particles is shown in Table 3.

| Skeleton particles | Amount of addition (wt %) | Time for completion of fusion (sec/100g at 1500° C) |
|---|---|---|
| | 0 | 21.6 |
| C | 3 | 37.8 |
| | 5 | 61.2 |
| | 1 | 24.0 |
| BN | 3 | 45.0 |
| | 5 | 92.4 |
| | 1 | 23.4 |
| $Si_3N_4$ | 3 | 43.2 |
| | 5 | 84.0 |
| | 1 | 21.6 |
| MnN | 3 | 40.8 |
| | 5 | 81.0 |

-continued

| Skeleton particles | Amount of addition (wt %) | Time for completion of fusion (sec/100g at 1500° C) |
|---|---|---|
| | 1 | 23.4 |
| $Cr_2N$ | 3 | 42.0 |
| | 5 | 82.8 |
| | 1 | 22.2 |
| $Fe_2N$ | 3 | 42.0 |
| | 5 | 82.8 |
| | 1 | 24.6 |
| AlN | 3 | 43.2 |
| | 5 | 86.4 |
| | 1 | 25.8 |
| TiN | 3 | 45.0 |
| | 5 | 90.0 |
| | 1 | 24.0 |
| ZrN | 3 | 43.8 |
| | 5 | 91.8 |

Table 2

| | Purity | Particle size |
|---|---|---|
| Nitride | 99.5% | 325 mesh |
| Carbon | 99.5% | 250 mesh |

Table 3

| Cao | SiO | $Al_2O_3$ | MgO | $Fe_2O_3$ | $Na_2O$ | NaF | $AlF_3$ |
|---|---|---|---|---|---|---|---|
| 35.5 wt % | 35.5 | 4.0 | 6.9 | 2.2 | 6.9 | 8.9 | 6.0 |

As shown in FIG. 1 and Table 1, the effects of the skeleton particles of the nitrides and of the carbon upon the fusion rate control of the casting powder show the same tendency. That is, the addition of the nitride as the skeleton particles to the casting powder can give the fusion properties quite similar to those given by the addition of the carbon to the casting powder.

It is still unknown at present how the addition of the nitride can control the fusion rate of the casting powder but it may be presumed that, fundamentally speaking, it intervenes between the droplets of the molten slag so as to retard the formation of fusion slag layer, by the aggregation, of the slag layer. It is thus necessary that the nitride to be added has the small particle size of 50 mesh or finer.

The amount of nitride, for example, boron nitride should preferably be 2% or more based upon the weight of the casting powders. As for the upper limit, there is no particular limitation. However, in view of the adiabatic effect as the hot top additive, it may be up to 10%. Better effect can not be effected even if it is added in an amount of more than 10%. Moreover, an extraneous addition of the nitride is not economical since the nitride itself is expensive.

Among various nitrides, boron nitride (BN) is most effective as the skeleton particles since it quite resembles with the carbon with respect to the crystal structure, physical properties and thermal properties.

Figure 2:
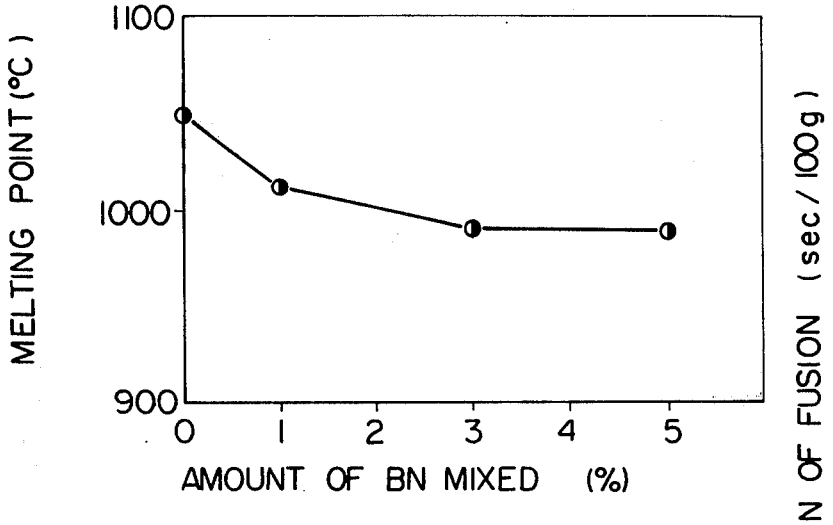
FIG. 2 is a graph showing the effect of the amount of BN upon the melting point of the casting powder.

As a result of measuring the melting point of the casting powder to which the boron nitride has been added as the skeleton particles, it has been found that the melting point of the casting powder is lowered as the amount of boron nitride mixed is increased as shown in FIG. 2.

Figure 3:
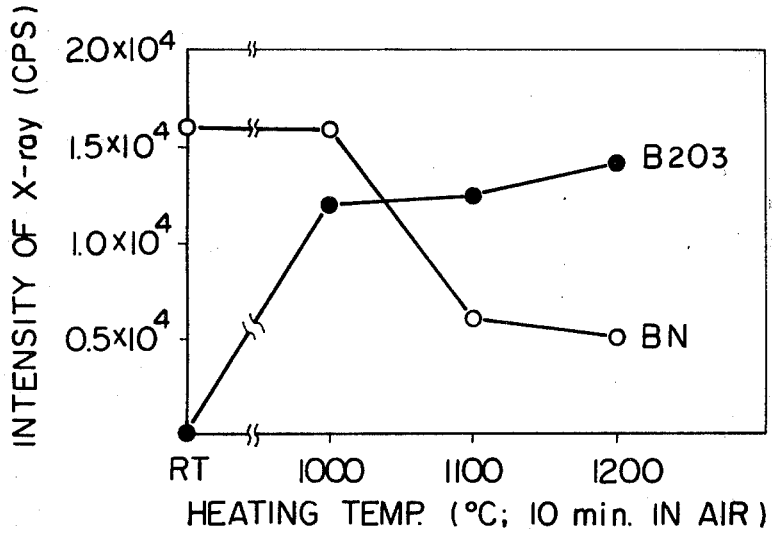
FIG. 3 is a graph showing the intensity of the strongest line of BN and $B_2O_3$ in the X-ray diffraction after BN is subjected to heat treatment.

In FIG. 3, the intensity of the strongest line of BN and $B_2O_2$ are shown in case the boron nitride is subjected to heat treatment in air, followed by X-ray diffraction. From this it is seen that the $B_2O_3$ can be observed to exist already at 1000° C or so. It is presumed that the BN is partially oxidized by heating according to the formula (1) below to produce boron oxide and that the boron oxide will lower the melting point as it is a strong flux.

$$4BN + 3O_2 \rightarrow 2B_2O_3 + 2N_2 \uparrow \quad (1)$$

Accordingly, it can be considered that if the production of boron oxide is prevented, even a lesser amount of born nitride can maintain the skeleton effect. In other words, it has now been found that if the oxidization of BN is prevented until the melting point of the casting powder, a lesser amount of BN is enough to maintain the skeleton effect.

Figure 4:
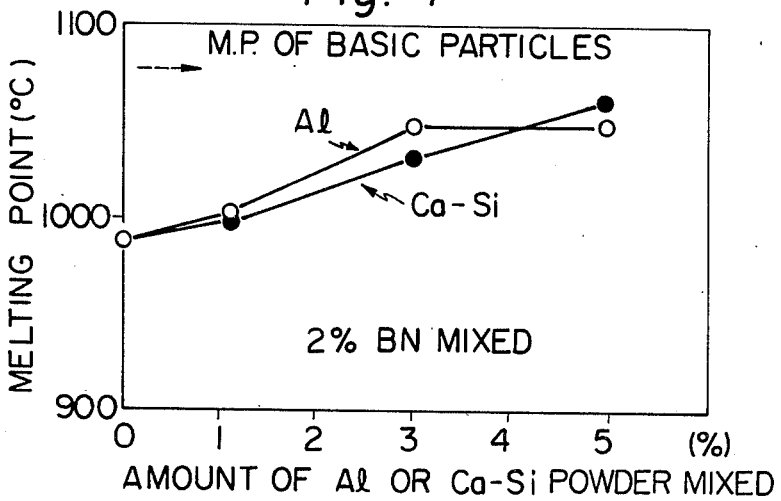
FIG. 4 is a graph showing the effect of preventing the lowering of the melting point by incorporating reducing agents.

As the inventor considers it as effective to incorporate some reducing agents to nitrides for preventing oxidation of boron nitride until the melting point of the casting powder, the Al and Ca—Si powder are mixed into the casting powder as the reducing agents besides the addition of 2% BN thereto, and the melting point is measured. The result is shown in FIG. 4, from which it can clearly be observed that the melting point is recovered up to that of the basic particles by the mixing of the reducing agents in an amount of 3% or more.

Figure 5:
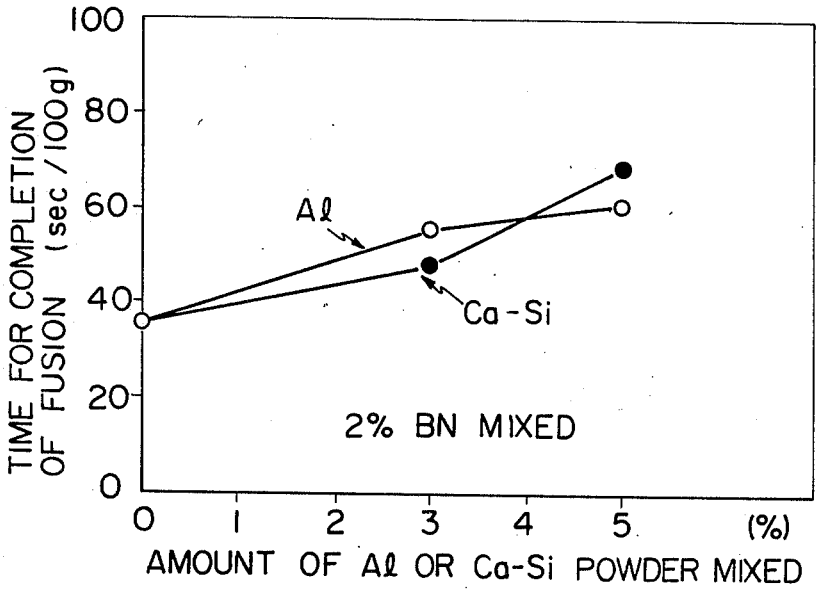
FIG. 5 is a graph showing the effect of the reducing agents upon the fusion rate of a casting powder having BN mixed therein.

In FIG. 5, the fusion rate of the casting powder having the same composition as above which has been charged into the molten AISI 304 steel kept at 1500° C is shown. From this it can be recognized that the fusion rate becomes slow as the amount of the reducing agent mixed is increased. It is thus concluded that by incorporating the reducing agent the BN can exert the skeleton effect in an amount less than that of the case when the BN is used singly. The above explanation regarding the skeleton particles has chiefly been directed to boron nitride, but the same is true substantially with the other nitrides.

In order to accomplish the reduction effect completely, it is necessary that the particle size of the reducing agent be as small as possible, which is 50 mesh or finer. The amount of the reducing agent mixed should preferably be not less than 1% based on the weight of the casting powder, its effect being stronger as the amount is increased. However, even if it is more than 10%, the corresponding effect can not be expected.

As for the effect of reduction, it has already been ascertained that other Si-containing alloys such as Fe—Si, Si—Mn, Si—Cr, etc. or the metallic silicon or calcium may exert similar effects.

Thus, practically speaking, the skeleton effect which is equivalent to that given by the addition of the carbon particles in an amount of about 5% can be obtained by incorporation a powdery reducing agent of not more than 50 mesh such as Ca—Si powder, Al powder, Si powder, Ca powder, etc. into the casting powder to which a powdery nitride of not more than 50 mesh has been added.

As a result of various studies upon the fusion rate control of the casting powder, it has futher been discovered that the fusion rate may depend largely upon the size of the basic particles and the skeleton particles. That is, it has been recognized that as the ratio of the diameter (D) of the basic particles to the diameter (*d*) of the skeleton particles becomes larger, the fusion rate of the casting powder becomes slower. Consequently, it has become possible to control the fusion rate by controlling the ratio of particle diameters and thereby to decrease the amount of skeleton particles to be added.

The mechanism why the fusion rate can be retarded by enlarging the diameter ration (D/*d*) of the basic particles and the skeleton particles is unknown. It is, however, presumed as follows.

The skeleton effect which prevents the contact and accumulation of the basic particles in case that the skeleton particles intervene between the basic particles at the time of fusion of the basic particles is itself same as the conventional findings. However, as the diameter of the basic particles becomes larger, the surface area per unit weight becomes smaller, which will save the number of the skeleton particles covering said area. If, in this case, the amount of the skeleton particles is not changed, the layer of the skeleton particles surrounding the basic particles can be thicker, which promotes the effect of preventing the contact and accumulation of the basic particles and thereby retards the fusion rate. Thus, according to the ratio of the diameter (D) of the basic particles to the diameter (d) of the skeleton particles, the fusion rate or the optimum amount of the skeleton particles to be mixed can be determined.

Figure 6:
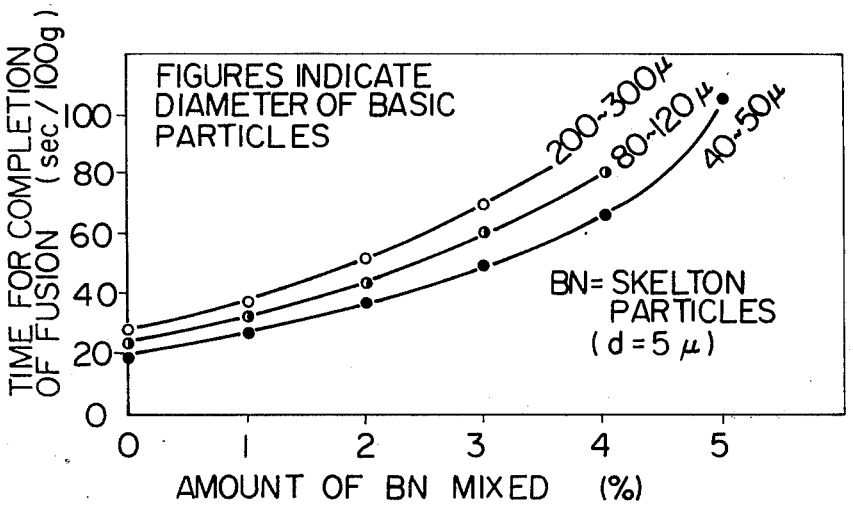
FIG. 6 is a graph showing the effect of the size of the basic particles upon the fusion rate when BN powder of $5\mu$ is used as the skeleton particles.

In FIG. 6 is shown the effect of the diameter of the basic particles upon the fusion rate in case that the casting powder having basic particles of various diameters, to which 0 to 5% of BN with the particle diameter of 5$\mu$ is also added, is charged into the 20 Kg molten AISI 304 steel kept at 1500° C.

In order to increase the diameter ratio (D/*d*), the diameter of the skeleton particles may be decreased or the diameter of the basic particles may be increased, both giving the same result.

The fusion rate of the casting powder which can be used practically is in the region which is more than 30 sec/100g as shown in FIG. 6. Accordingly, the relation between the practical diameter ratio (D/*d*) and the practical mixing ratio (C%) of the skeleton particles to be added can be given from the graph of FIG. 6. In this case it is required that at least 80% of the basic particles and of the skeleton particles should satisfy the distribution of the particle diameters which is within ±25% of the respective average particle diameters.

Figure 7:
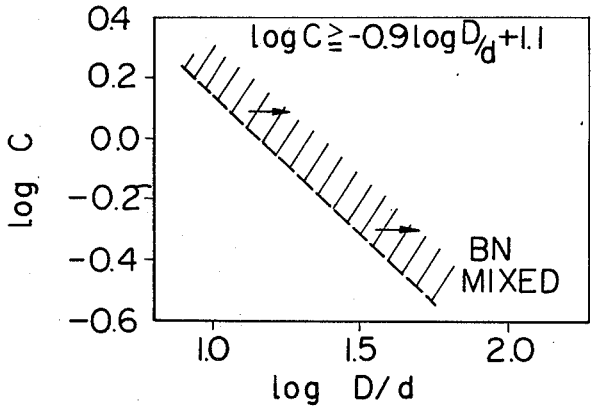
FIG. 7 is a graph showing a relation between the limit amount of the skeleton particles required and the ratio of particle diameter.

This limitation in the mixing is shown in FIG. 7, from this it is seen that the amount (C) of the skeleton particles can be decreased according to the formula shown below.

$$\log C \geqq -0.9 \log D/d + 1.1$$

In the casting powder according to this invention, the powder carbon is not mixed as explained above so as to decrease the amount of carbon as far as possible. However, the carbon in an amount of 1% or less mixed in the material of the casting powder is allowable as incidental impurities. As a matter of fact, the carburization and carbon pick-up caused by such small amount of carbon is not so large.

The examples of this invention are hereinafter described.

EXAMPLE 1

Figure 8:
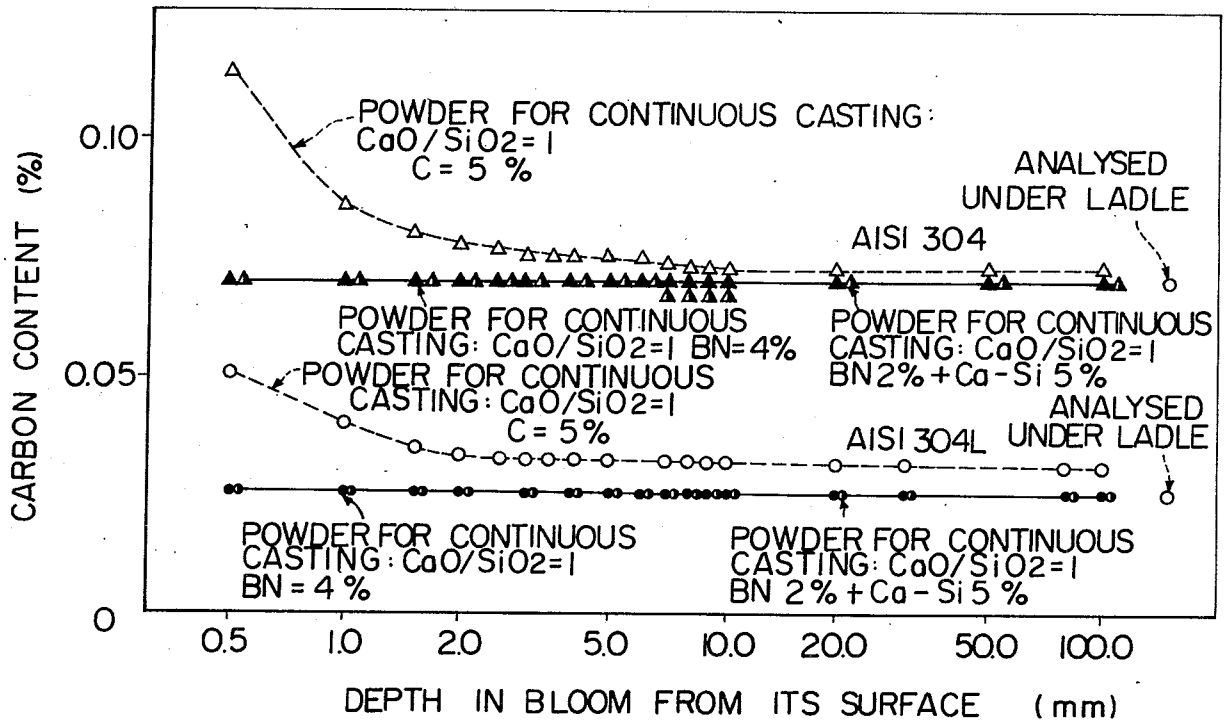
FIGS. 8 to 10 are graphs showing the conditions of carburization and carbon pick-up in the direction of depth from the surface of blooms which has been made by a mold of continuous casting to which a casting powder according to this invention has been charged in comparison with the prior art.

FIG. 8 shows the carburization and carbon pick-up in the direction of depth from the surface to the central part of the 210 square mm bloom which has been obtained by continuous casting of AISI 304 or 304L with the addition of 5% carbon-mixed conventional casting powder, 4% BN-mixing casting powder of this invention or 2% BN + 5% Ca—Si mixed casting powder of this invention.

From FIG. 8, it is seen that in the bloom obtained by adding the casting powder of this invention, the carburization and carbon pick-up can be fully prevented as compared with the case in which the conventional casting powder is used; and that when a reducing agent has been added, the same result can be given even if the amount of BN used is small.

EXAMPLE 2

Figure 9:
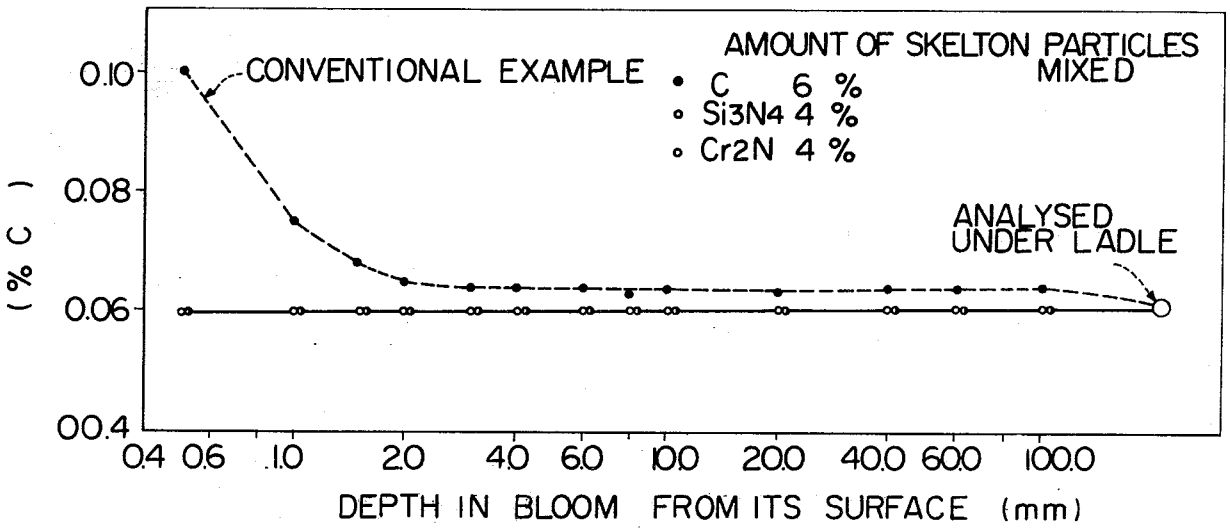

The AISI 304 and AISI 304L are subjected to continuous casting to produce 210 square mm bloom while 5% carbon particles-containing conventional casting powder and 4% various nitride particles-containing casting powder of this invention are added to the mold for continuous casting. FIG. 9 shows the carburization and carbon pick-up in the above bloom by sampling in the direction of depth from the surface to the center of the bloom and analysing the carbon content therein.

From FIG. 9, it is obvious that the carburization and carbon pick-up can completely be prevented in the bloom obtained by adding the casting powder of this invention as compared with the use of the conventional casting powder.

EXAMPLE 3

Table 4 shown below indicates the results of studies about the effect of the diameter ratio of the baic particles to the skeleton particles upon the fusion rate of the casting powder. It is thus possible to largely decrease the amount of the skeleton particles used by adjusting the diameter ratio to the suitable range.

Table 4

| Samples No. | Average particle diameter (D) | Skeleton particles: Kind | Skeleton particles: Amounts (wt %) | Skeleton particles: Particle diameter (d) occupying more than 80% | Diameter ratio D/d | Fusion rate sec/100g | Remarks |
|---|---|---|---|---|---|---|---|
| 1 | 45 | BN | 2.0 | 5 | 9 | 37 | 0 |
| 2 | 100 | BN | 1.5 | 5 | 20 | 37 | O |
| 3 | 250 | BN | 1.0 | 5 | 50 | 37 | O |
| 4 | 45 | TiN | 2.0 | 5 | 9 | 37 | O |
| 5 | 45 | $Si_2N_4$ | 2.0 | 5 | 9 | 37 | O |
| 6 | 45 | AlN | 2.0 | 5 | 9 | 37 | O |
| 7 | 45 | ZrN | 2.0 | 5 | 9 | 37 | O |
| 8 | 45 | $Cr_2N$ | 2.0 | 5 | 9 | 37 | O |
| 9 | 45 | $Fe_4N$ | 2.0 | 5 | 9 | 37 | O |
| 10 | 45 | BN | 2.0 | 10 | 4.5 | 30 | X |
| 11 | 45 | BN | 0.5 | 10 | 4.5 | 21* | X |

*Uncastable.
O Example of this invention.
X Comparative examples.

EXAMPLE 4

Figure 10:
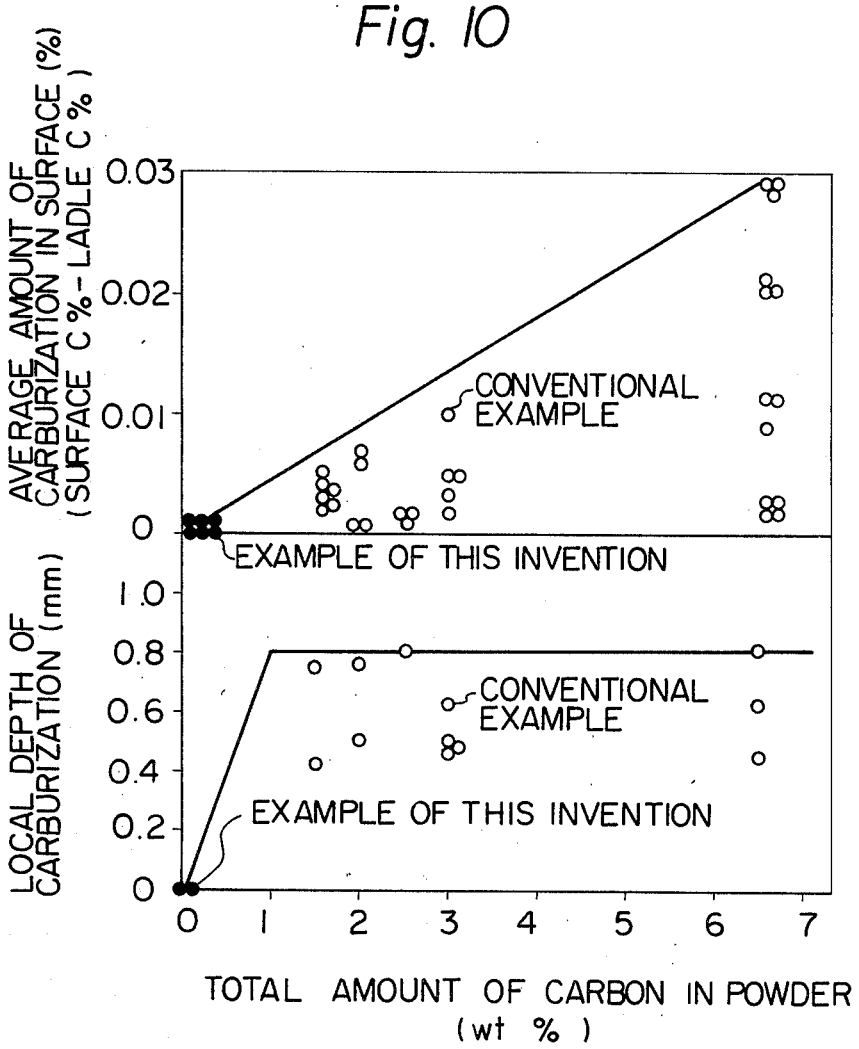

With AISI 304 steel, blooms of 210 square mmm and 210 × 250 mm are cast using the casting powder of this invention and of the prior art. The result of control of carburization in the surface of the blooms are shown in FIG. 10 in comparison with each other. It has thus been found that the casting powder of this invention exerts excellent advantages in castability and surface condition over the conventional casting powder, which completely prevents the surface carburization and carbon pick-up and makes it possible to obviate re-finishing of the product bloom.

EXAMPLE 5

Figure 11:
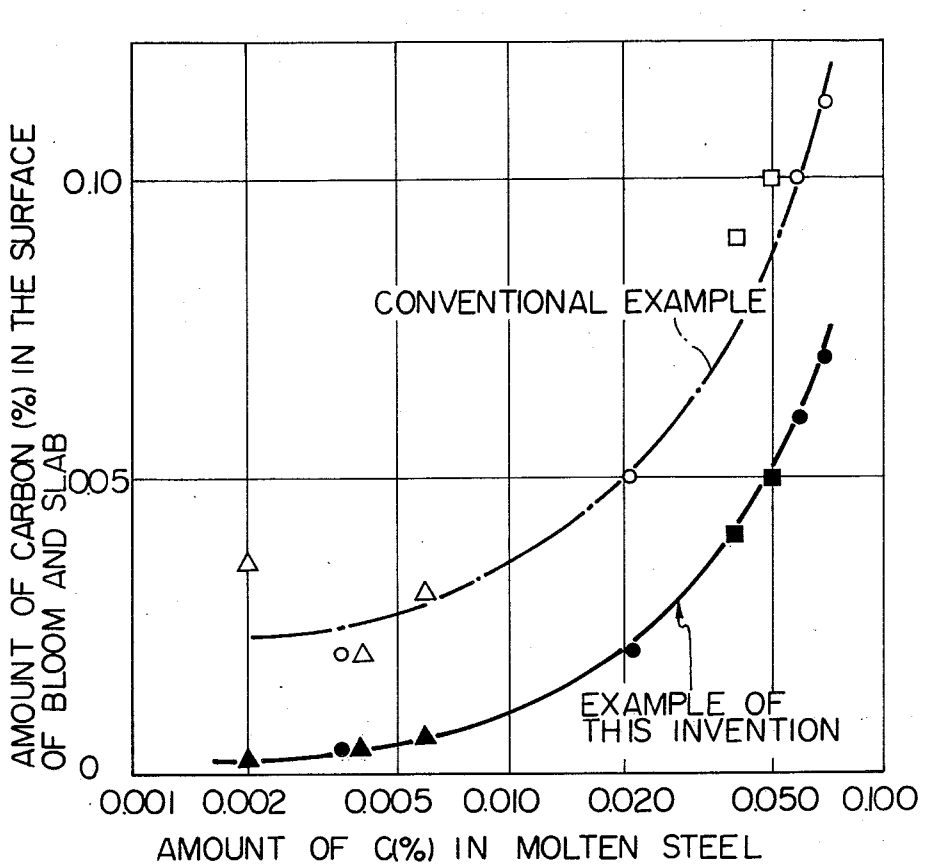
FIG. 11 is a graph showing the amounts of carburization in the surface of blooms or slabs of various steels in comparison between this invention and the prior art.

The results of comparison between the present invention and the prior art regarding the amount of carburization in the surface of blooms and slabs of stainless steel, Si-steel and low carbon steel are shown in FIG. 11.

The word, the casting powder herein used includes not only the powdered mold additives but also the hot top additives, the protecting agents for the surface of molten steel, etc., which can be used in ordinary ingot casting and continuous casting, etc. The use thereof does not injure its fusion characteristic and yet does not cause any carburization and carbon pick-up in the ingot, slab or bloom which has heretofore been encountered in the process of this kind.

I claim:

1. A casting composition for preventing carburization of steel during the casting thereof, said composition comprising a powdery basic material, and particles of a nitride material contained in said basic material as a skeleton therefor, said nitride material being in particle size of 50 mesh or finer, said basic materials containing substantially no carbon particles.

2. The casting composition according to claim 1 in which said nitride material is included in an amount of 2 to 10% by weight based on the casting composition.

3. The casting composition according to claim 1 in which the nitride material is selected from the group consisting of BN, $Si_3N_4$, MnN, $Cr_2N$, $Fe_4N$, AlN, TiN, and ZrN.

4. The casting composition according to claim 2 in which the nitride material is selected from the group consisting of BN, $Si_3N_4$, MnN, $Cr_2N$, $Fe_4N$, AlN, TiN and ZrN.

5. The casting composition according to claim 1 further including a reducing agent, said reducing agent being in particle size of 50 mesh or finer.

6. The casting composition according to claim 5 in which said reducing agent is present in an amount of 1 to 10% by weight of the casting composition.

7. The casting composition according to claim 5 in which the reducing agent is selected from the group consisting of Al metal, Ca metal, Si metal, Ca alloy and Si alloy.

8. The casting composition according to claim 6 in which the reducing agent is selected from the group consisting of Al metal, Ca metal, Si metal, Ca alloy and Si alloy.

9. The casting composition according to claim 1 in which the relation of the skeleton particles mixing ratio (C%) with the diameter ratio (D/d) of the basic material particles to the skeleton particles is defined by the formula:

$$\log C \geqq -0.9 \log D/d + 1.1$$

* * * * *

UNITED STATES PATENT OFFICE

CERTIFICATE OF CORRECTION

PATENT NO. : 4,038,067

DATED : July 26, 1977

INVENTOR(S) : Hidemaro Takeuchi

It is certified that error appears in the above-identified patent and that said Letters Patent are hereby corrected as shown below:

At Col. 2, after line 59, add the following:

-- Table 1

Effect of the amount of skeleton particles added upon the time for completion of fusion of the casting powder--

At Col. 3, line 7, "$Fe_2N$" should read --$Fe_4N$--.

At Col. 3, line 64, "$B_2O_2$" should read --$B_2O_3$--.

At Col. 6, Table 4 (11th line), "$Si_2N_4$" should read --$Si_3N_4$--.

At Col. 6, line 66, "210 square mmm" should read --210 square mm--.

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*